US006550095B2

(12) United States Patent
Hawkins et al.

(10) Patent No.: US 6,550,095 B2
(45) Date of Patent: Apr. 22, 2003

(54) FLEX DETACH TOOTHBRUSH

(76) Inventors: Wynter Shynet Hawkins, 4907 Shafer St., Norfolk, VA (US) 23513; Marvin Hawkins Hawkins, 4907 Shafer St., Norfolk, VA (US) 23513

( * ) Notice: Subject to any disclaimer, the term of this patent is extended or adjusted under 35 U.S.C. 154(b) by 0 days.

(21) Appl. No.: 10/153,354

(22) Filed: May 24, 2002

(65) Prior Publication Data

US 2002/0178524 A1 Dec. 5, 2002

Related U.S. Application Data

(63) Continuation-in-part of application No. 09/502,952, filed on Feb. 11, 2000, now abandoned.

(51) Int. Cl.[7] ..... A46B 9/04

(52) U.S. Cl. ..... 15/167.1; 15/144.1; 15/145; 15/172; 15/176.1

(58) Field of Search ..... 15/144.1, 172, 15/167.1, 167.2, 176.1, 176.6, 201, 145

(56) References Cited

U.S. PATENT DOCUMENTS

| | | | | | |
|---|---|---|---|---|---|
| 430,909 | A | * | 6/1890 | Wonderly | 15/172 |
| 541,727 | A | * | 6/1895 | Dennis | 15/172 |
| 1,326,638 | A | * | 12/1919 | Block | 15/172 |
| 1,680,558 | A | * | 8/1928 | Loiselle | 15/172 |
| 1,968,303 | A | * | 7/1934 | McMath | 15/167.1 |
| 2,091,716 | A | * | 8/1937 | Petta | 15/172 |
| 2,609,251 | A | * | 9/1952 | Haupt | 403/97 |
| 3,886,618 | A | * | 6/1975 | Paoletti | 15/172 |
| 4,020,521 | A | * | 5/1977 | Velasquez | 15/172 |
| 4,330,896 | A | * | 5/1982 | Booth | 15/172 |

FOREIGN PATENT DOCUMENTS

| | | | | |
|---|---|---|---|---|
| FR | 2446617 | * | 9/1980 | 15/167.2 |
| FR | 2583963 | * | 1/1987 | 15/172 |
| GB | 17808 | * | 12/1915 | 15/172 |
| GB | 2101476 | * | 1/1983 | 15/172 |

* cited by examiner

*Primary Examiner*—Gary K. Graham

(57) ABSTRACT

A flexible and detachable toothbrush for allowing the head of the toothbrush to flex to 180 degree and to be replaced when it becomes worn or damaged. The inventive device includes head having curve to the back of head in order to rotate on handle with round surface at tip. The simplified disconnection of head from handle to allow head to be removed when it becomes worn and replaced with new head and bristles without having to replace the handle.

1 Claim, 4 Drawing Sheets

FLEX DETACH TOOTHBRUSH

This is a continuation-in-part of application Ser. No. 09/502,952 filed Feb. 11, 2000, now abandoned.

BACKGROUND OF THE INVENTION

1. Field of the Invention

The present invention relates to toothbrushes, and more specifically it relates to a new and improved flexible toothbrush for allowing the head of the toothbrush to rotate 180 degrees, and to be detached and replaced when it becomes worn.

2. Description of the Prior Art

Various types of flexible and detachable toothbrushes are known in the prior art. A typical example of patented toothbrushes includes U.S. Pat. No. 2,427,411 to Krueger; U.S. Pat. No. 424,716 to Lichtenstein; U.S. Pat. No. 2,022,039 to House; U.S. Pat. No. 430,909 to Wonderly; U.S. Pat. No. 541,727 to Dennis; U.S. Pat. No. 5,864,915 to Ra; U.S. Pat. No. 387,204 to Nicholson; U.S. Pat. No. 1,134,450 to Goldy; U.S. Pat. No. 381,206 to Mannino; which are all illustrative of such prior art.

While these devices may be suitable for the particular purpose to which they address, they are not suitable for allowing the head of the toothbrush to flex to a 180 angle. Along with the simplified process for detachment of toothbrush making it easier for consumer to replace when it becomes worn or damaged.

In these respects, the flex detach toothbrush according to the present invention substantially departs from the conventional concepts and designs of the prior art, and in doing so provides an apparatus primarily developed for the purpose of allowing the head of the toothbrush to flex 180 degrees and to be replaced by simplified process when it becomes worn or damaged.

SUMMARY OF THE INVENTION

In view of the foregoing disadvantages inherent in the known types of toothbrushes now present in the prior art, the present invention provides a new extended flexibility along with simplified process for detaching of toothbrush head from handle in order to be replaced when it becomes worn. As such, the purpose of the present invention, which will be described subsequently in greater detail, is to provide an improved toothbrush which has all the advantages of the prior art toothbrushes and non of the disadvantages.

To attain, the present invention comprises of a head that is movable to a 180 degree angle allowing brushing of difficult to reach areas and ease of brushing motion across teeth back and forth wherein bristle never leaves teeth for switching of sides. The movable head is accomplished by positioning of curve located at back of the head which connects to round surface handle tip which attaches and detach at tip of handle.

There has thus been outlined, rather broadly, the more important features of the invention in order that the detailed description thereof may be better understood, and in order that the present contribution to the art may be better appreciated. In this respect, before explaining at least one embodiment of the invention in detail, it is to be understood that the invention is not limited in its application to the details of construction and to the arrangements of the components set forth in the following description or illustrated in the drawing. The invention is capable of the embodiments and of being practiced and carried out to various degrees. Also, it is to be understood that the phraseology and terminology employed herein are for the purpose of the description and should not be regarded as limiting.

A primary object of the present invention is to provide a 180 degree flexible toothbrush for effective brushing.

A second object of the present invention is to utilize moment of brushing by allowing head to easily flow from one side of teeth to other side without moving bristles from off teeth surface not departing from mouth while brushing An additional object is to provide a detachable toothbrush with replaceable head without replacing handle.

Another further object is to provide a detachable toothbrush that can easily be pulled apart for attachment and detachment of head/bristles when it becomes worn or damaged.

Another objection is to provide a toothbrush that reaches the back teeth effectively without handle obstructing.

Another objection is to provide a toothbrush that controls movements of head.

BRIEF DESCRIPTION OF THE DRAWINGS

Various other features and advantages of the present invention will become fully appreciated and becomes better understood when considered in conjunction with the accompanying drawings, of which.

DESCRIPTION OF THE PREFERRED EMBODIMENT

Figure 1:
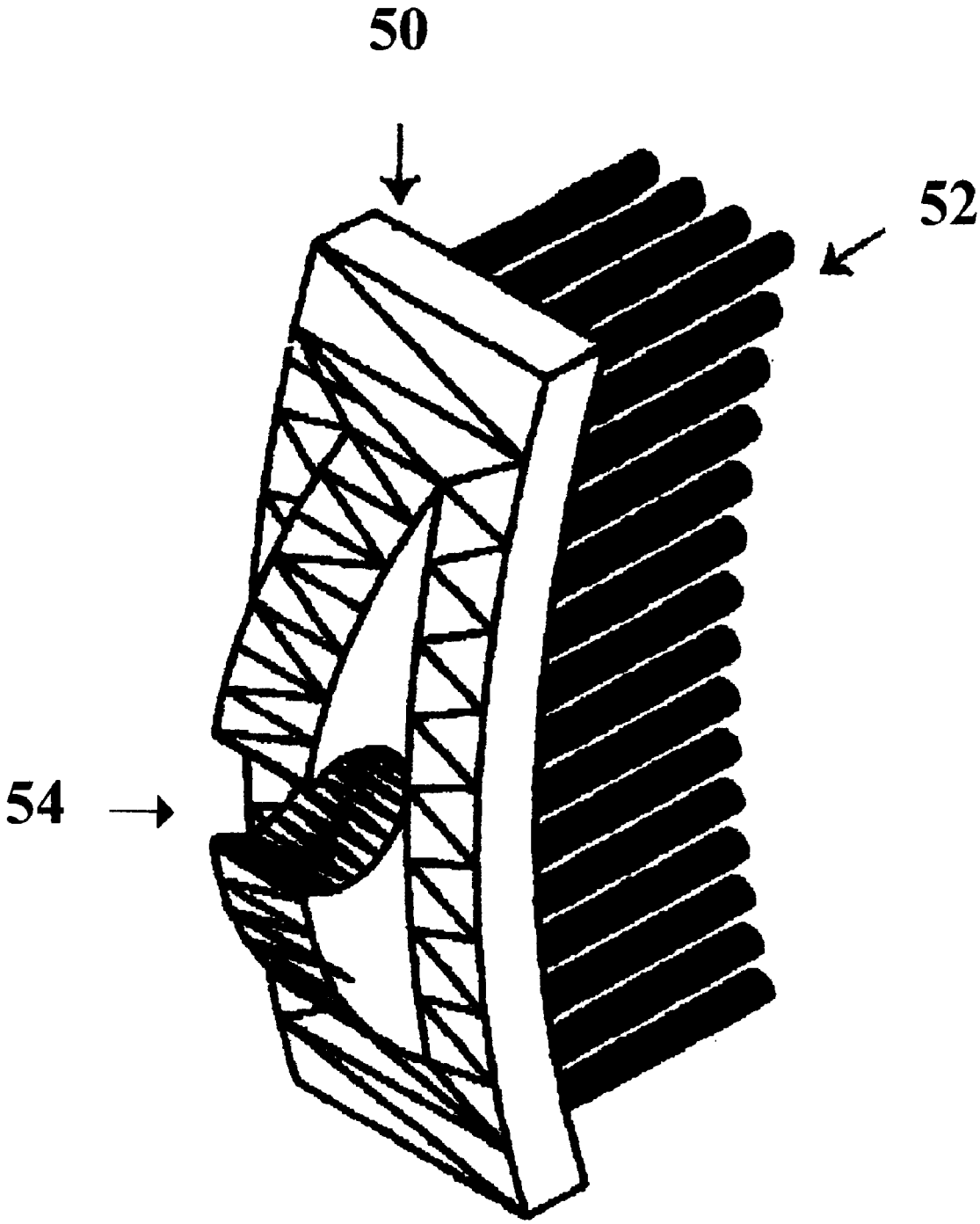
FIG. 1 is a back exploded view of head with grooves in arch of the present invention.
Figure 2:
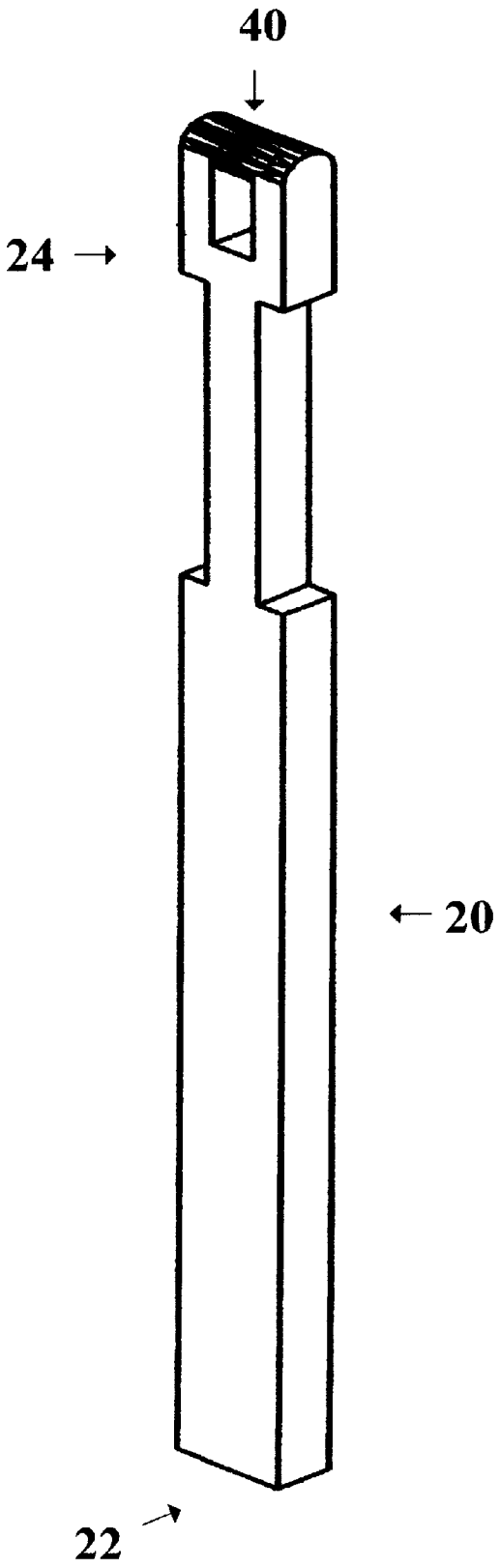
FIG. 2 is a top view of handle with groove at top of the present invention.
Figure 3:
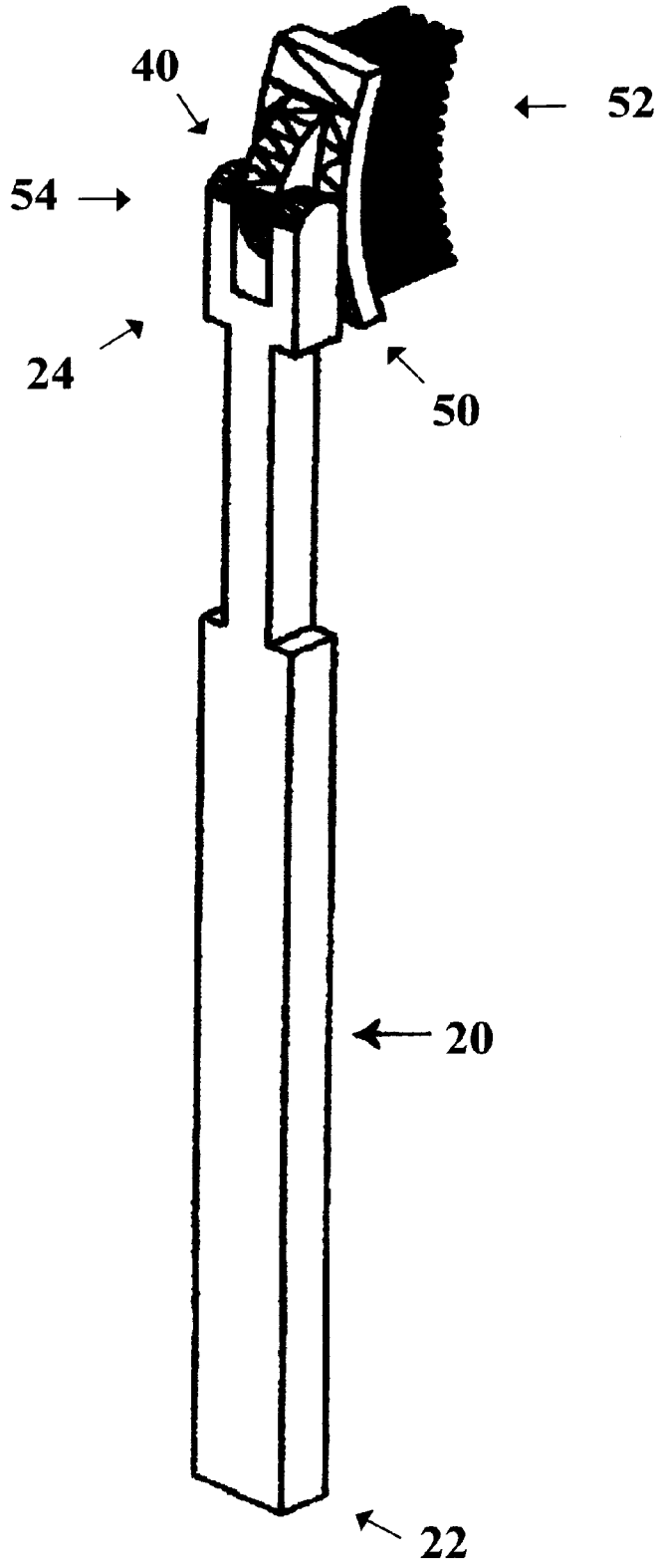
FIG. 3 is a view of handle and head connected together of the present invention.
Figure 5:
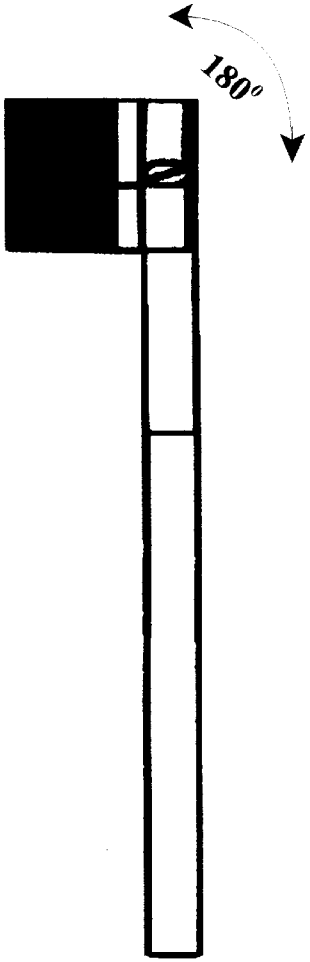
FIG. 5 is a view showing the right rotation of 180 degree of the present invention.
Figure 4:
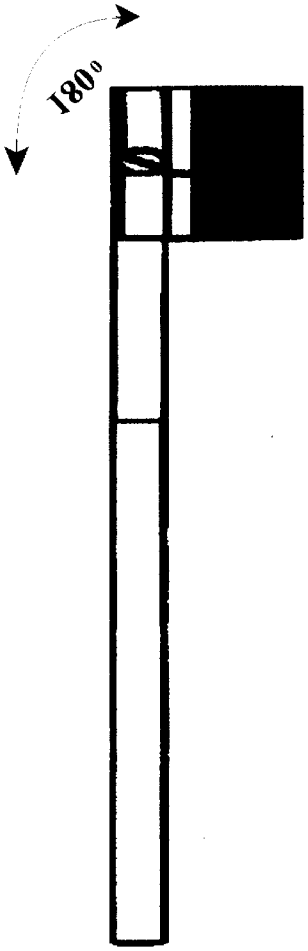
FIG. 4 is a view showing the left rotation 180 degree of the present invention.

Turning now descriptively to the drawings which will enable one skilled in art to make and/or use this invention. FIGS. 1 through 3 illustrate a Detachable toothbrush system which comprises a handle 20, a head 50 having plurality of bristles 52 to be removed when it becomes worn and replaced with a new head 50 and bristles 52 without having to replace the handle 20. A head which is movable on the connector to 180 degree allowing brushing of difficult to reach areas of a user's teeth with grooves in back side arch 54. A handle tip with grooves 40 which controls movement of head.

As shown in FIGS. 1–3 of the drawings the handle 20 is an elongate structure having a first end 22 and a second bifurcated end 24. The handle 24 having an opening to allow head 54 to move at 180 degree angle. The handle 20 may be comprised of a solid or hollow material as can be appreciated. A head with an arcuate protrusion with an arch opening at back 54 to allow handle to connect as shown in FIG. 3 of the drawings. Handle having a round non-movable tip 40 supports the head 50 having plurality of bristles 52 allowing swivel motion of the head 50 during the brushing of the teeth in reaching difficult areas. The handle 24 to be construction of any well known connection structure that allows the capture, release and swivel thru grooves as shown in FIG. 2 of drawing.

As shown in FIG. 1 of the drawing the attachment located to the backside of the head 50 opposite of the bristles 52. As shown in FIG. 3 of the drawings the connection is attached at the center portion of the head 50 for providing the maximum balancing during operation of the invention within the mouth of the user.

The head 50 is rotatably supported by the handle 24 with grooves to allow control movement thereby allowing the head 50 to be rotated in a wide range of motion. It can be appreciated that the handle tip 40 is non-movable connecting to the rest of handle while allowing opening right underneath of head 24 to be attach and detached for disposable units of the present invention. The bristles 52 may be comprised to any well known material commonly utilized for bristles 52 within toothbrushes.

In use, the user utilizes the present invention as a toothbrush. During brushing the user extends the handle 20 and the head 50 into the user's mouth where the bristles 52 engage the surface of the user's teeth. When brushing the rear portion of the user's teeth the head 50 may become slightly flattened on teeth surface allowing complete engagement on the surface of the teeth by the bristles 52. The user's continues to brush until they are finished. After a period of use the bristles 52 and the head 50 may become worn and/or damaged. The user then simply pull apart the head 54 and the handle 40 thereby allowing the head 50 to be removed by the user from the handle 40. The user push together the head 54 and the handle 40 while simultaneously inserting a new head 50 into the handle 40. The user continues this process and repeats the replacement fo the head 50 and bristles 52 as desired.

As to a further discussion of the manner of usage and operation of the present invention, the same should be apparent from the above description. Accordingly, no further discussion relating to the manner of usage and operation will be provided.

With respect to the above description then, it is to be realized the optimum dimensional relationships for the parts of the invention, to include variations in size, materials, shape, form, function and manner of operation, assembly and use, are deemed to be within the expertise of those skilled in art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope if the invention.

We claim:

1. An adjustable head toothbrush, said toothbrush comprising:

an elongated toothbrush handle having first and second ends, said second end being bifurcated and fixedly supporting a grooved, round tip between said bifurcation and said bifurcation defining an opening through the handle adjacent said tip;

a toothbrush head having first and second opposite sides, said first side supporting a plurality of bristles thereon, said second side having an arcuate protrusion thereon which defines an arched opening therein, said arched opening having grooves therein, said arched opening receiving said round tip such that said grooves on said tip engage said grooves in said arched opening;

wherein said head is movable through a 180 degree angle of rotation about said tip with respect to said handle between first and second positions and in each of said positions, a different portion of said arcuate protrusion engages in said opening through the handle, said arched opening enabling transverse removal of said head from said tip of said handle.

* * * * *